US007823232B2

(12) United States Patent
Tinke et al.

(10) Patent No.: US 7,823,232 B2
(45) Date of Patent: Nov. 2, 2010

(54) DEVICE FOR PREVENTING DECUBITUS

(75) Inventors: Cornelis Willem Tinke, WP Barendrecht (NL); Hans Voorwinde, NA Papendrecht (NL)

(73) Assignee: Hans Voorwinde Beheer B.V. (NL)

( * ) Notice: Subject to any disclaimer, the term of this patent is extended or adjusted under 35 U.S.C. 154(b) by 350 days.

(21) Appl. No.: 11/908,547

(22) PCT Filed: Mar. 13, 2006

(86) PCT No.: PCT/NL2006/000131

§ 371 (c)(1),
(2), (4) Date: Oct. 6, 2007

(87) PCT Pub. No.: WO2006/098616

PCT Pub. Date: Sep. 21, 2006

(65) Prior Publication Data

US 2008/0201848 A1 Aug. 28, 2008

(30) Foreign Application Priority Data

Mar. 14, 2005 (NL) ..... 1028539

(51) Int. Cl.
*A47C 23/06* (2006.01)

(52) U.S. Cl. ..... 5/237; 5/236.1; 5/600; 5/613; 267/89; 267/107

(58) Field of Classification Search ..... 5/236.1, 5/237, 933, 935, 936, 600, 239–245, 715, 5/722, 943, 613; 267/89, 107, 158, 164
See application file for complete search history.

(56) References Cited

U.S. PATENT DOCUMENTS 5,862,550 A * 1/1999 Cosani ..... 5/612
5,953,773 A 9/1999 Asada et al.

FOREIGN PATENT DOCUMENTS

| | | | |
|---|---|---|---|
| DE | 103 07 916 | A1 | 9/2004 |
| EP | 0 391 759 | A1 | 3/1990 |
| JP | 8-10289 | A | 1/1996 |
| JP | 63-279845 | A | 1/1996 |

* cited by examiner

*Primary Examiner*—Robert G Santos
*Assistant Examiner*—Nicholas Polito
(74) *Attorney, Agent, or Firm*—Brooks Kushman P.C.

(57) ABSTRACT

Device for preventing decubitus, consisting of a number of adjacent members (1) which are attached to a base and which members (1) are covered with a layer (2) of elastic material which defines a reclining surface for a patient. Each member comprises at least one elastic panel whose two opposite ends are connected to one another via a pulling element (6, 13) in order to pull the two ends towards one another, while bending the said panel, so that the vertical height of the member increases. The device also comprises a control device (3) for activating the pulling element for one or more of the said members as desired. The pulling element preferably consists of a wire, rod or strip of memory metal, which can assume its original contracted position by means of heating.

7 Claims, 4 Drawing Sheets

DEVICE FOR PREVENTING DECUBITUS

The present invention relates to a device for preventing decubitus.

Static systems for preventing decubitus or bedsores are known which are designed to support the body of a patient as evenly as possible and over as large an area as possible, so as to prevent pressure peaks.

In addition, dynamic systems are also known. An example thereof is what is known as an alternating mattress, which consists of a large number of compartments extending over the width of the mattress, each of which is connected to an air pump. The object in this case is to relieve the pressure in a specific section of the area supporting the patient. This object is achieved by increasing the pressure in certain compartments and decreasing the pressure in the intermediate compartments. To this end, a suitable control system is present with which the pressure in the individual compartments can be varied according to a predetermined pattern and a predetermined cycle. The drawback of such mattresses is that they take up a considerable amount of space and are consequently awkward to handle. Furthermore, the compartments are relatively large.

It is an object of the invention to provide a device which operates according to the principle of the alternating mattress, yet is lightweight and easy to handle.

Another object is to provide a device for preventing decubitus, which can easily be fitted to existing mattresses or to another base for supporting a patient.

This object is achieved according to the invention by a device which has the following distinguishing features:

- a number of adjacent members which are attached to a base and which members are covered with a layer of elastic material which defines a reclining surface
- each member comprises at least one resilient panel whose two opposite ends are connected to one another via a pulling element in order to be able to move the two ends of the resilient panel towards one another, so that the said panel can assume a curved position, in which the member has a relatively great vertical height
- a control device for activating the pulling element for one or more of the members as desired.

Preferably, the pulling element according to the invention consists of one or more wires made of memory metal, which wires are connected to a heating element controlled by the control device in order to heat the wire, and which wires are designed such that they assume a contracted position upon heating, with the elastic panel assuming the curved position.

In this way, each individual member can be activated by means of the control device, with the pulling element contracting and the elastic panel bulging, i.e. exerting an upward pressure to the body of a patient which may be resting thereon. By suitably selecting the members to be activated according to a specific cycle, the body of the patient resting on the members can be supported at varying locations, thus enabling the effective prevention of the occurrence of decubitus wounds.

According to an advantageous embodiment of the invention, each member consists of two identical elastic panels, which are arranged in parallel and one above the other and the adjoining ends of which are connected to one another via a rigid beam and the pulling element is arranged between the two beams, in such a manner that the panels assume a slightly curved position in the unstressed state of the pulling element. As a result, individual members are obtained, whose vertical displacement is virtually doubled when the pulling element is contracted, compared to a member having a single elastic panel.

The members are attached to the base and/or the covering layer of elastic material, for example by means of bonding, so that the device constructed from individual members is lightweight and easy to handle.

The invention is explained in more detail with reference to the attached drawing, in which:

FIG. 1 diagrammatically shows a top view of a device according to the invention;

FIG. 2 shows a side view of the device according to FIG. 1;

FIG. 3 diagrammatically shows a perspective view of a member of the device according to FIGS. 1 and 2 in the activated state;

Figure 1:
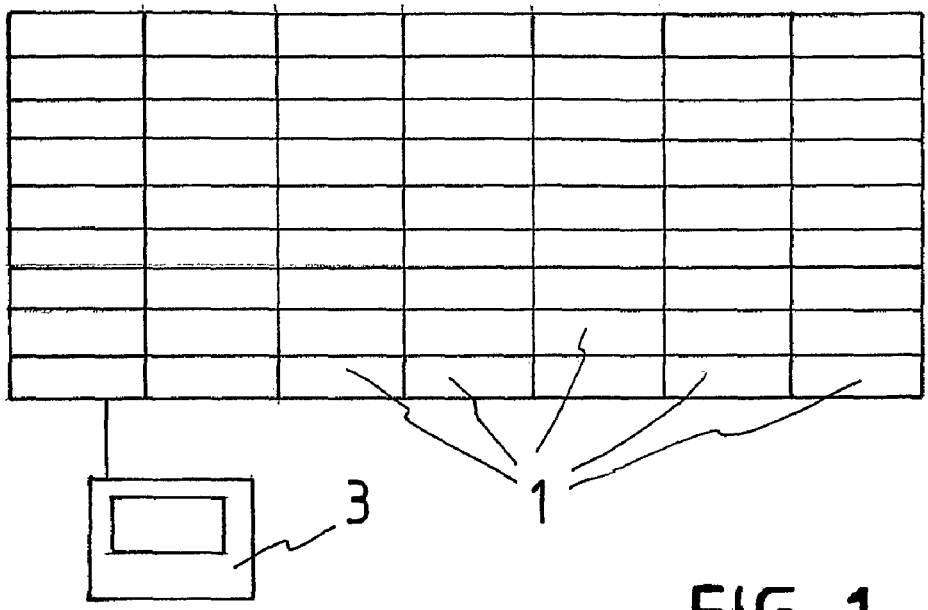
Figure 2:
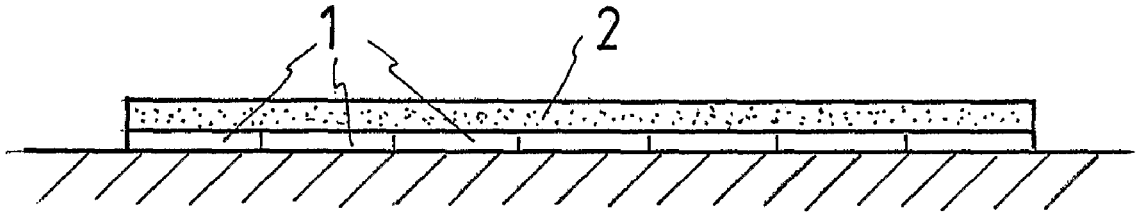

As can be seen in FIGS. 1 and 2, the device according to the invention consists of a number of adjacent members 1 arranged in a single plane, which, in plan view, are essentially in the shape of a rectangle. Each of the members is flat so that the device overall has the shape of a relatively thin panel, which forms the reclining surface for the patient. In FIG. 2, the members are covered with a layer 2 of a flexible elastic material, such as foam rubber. Each of the members is separately connected to a control device 3, with the aid of which the individual members can be activated, as will be discussed below. For use, the device can be positioned on any suitable base.

Figure 3:
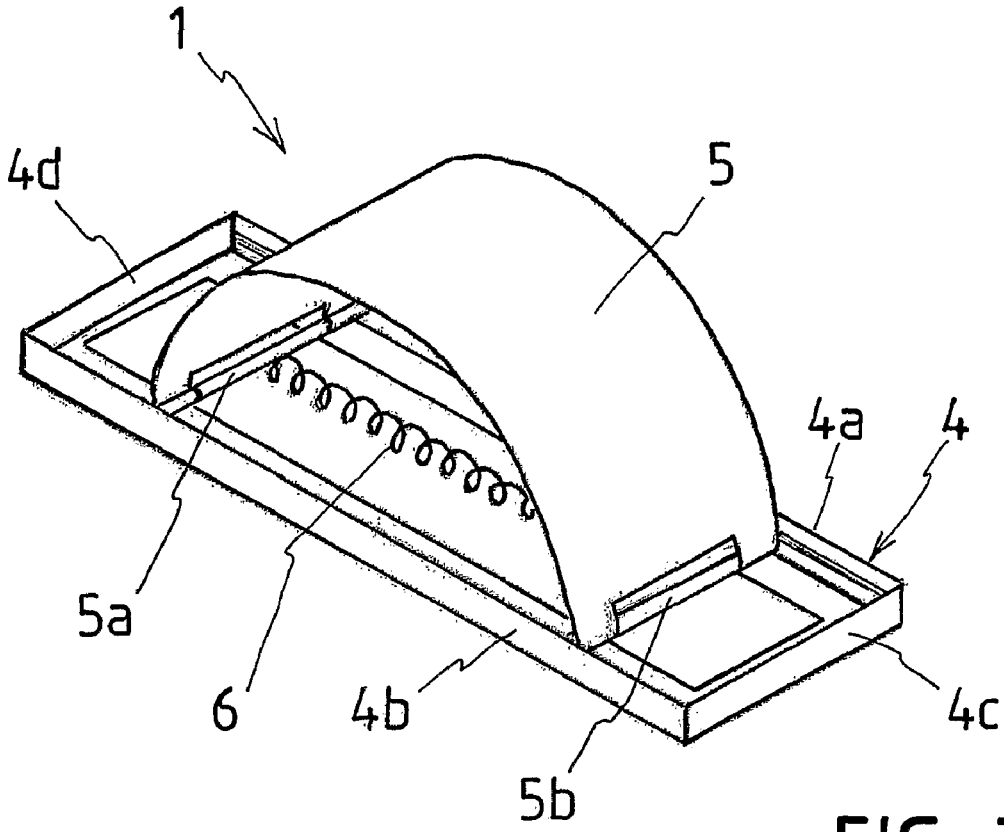
Figure 4:
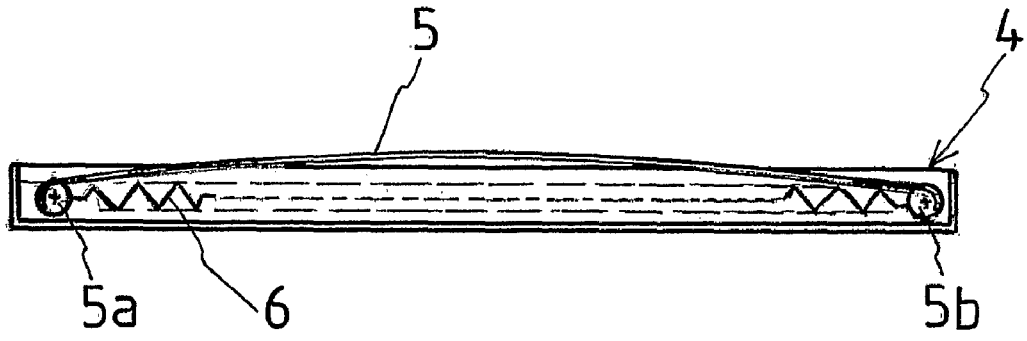
FIG. 4 shows a side view of the member from FIGS. 1 and 2 in the unstressed, that is to say non-activated state.

FIGS. 3 and 4 diagrammatically show an illustration of an embodiment of an individual member 1, from which the device according to FIGS. 1 and 2 is made up. As can clearly be seen, this member 1 consists of a rectangular frame 4 having two longitudinal sides 4*a* and 4*b* which are connected to one another at the ends by means of two transverse sides 4*c* and 4*d*. Within the frame, an elastic panel or leaf spring 5 is arranged, which leaf spring covers substantially the entire surface enclosed by the frame. At each end, the leaf spring has a guide pin 5*a* and 5*b*, respectively, connected to it which is guided in turn in the side walls 4*a* and 4*b* of the said frame 4 lying opposite one another. In this manner, the guide pins can move towards one another, as a result of which the leaf spring 5 assumes the convex position illustrated in FIG. 3 and move away from each other until the leaf spring assumes the flat position illustrated in FIG. 4. The movement of the guide pins 5*a* and 5*b* is effected by a pulling element 6 which is arranged between these pins and consists of a coil spring 6 made from memory metal, but may expediently also consist of wires or strips made from memory metal.

The pulling element 6 is designed such that it contracts upon heating and returns to its original expanded state upon cooling down. Heating the pulling element can be effected by electrical heating means (not shown) which are driven by the control device 3. This makes it possible to select the members 1 to be activated as well as the time period of the activation by means of this control device, so that a desired pattern and cycle of patterns can be set.

Contracting the pulling element thus results in the leaf spring assuming a convex position and thus exerting an upward force on the body of a patient supported thereon. In order to distribute this upward force somewhat and increase the comfort of the patient, a layer 2 of flexible material, such as foam plastic, is provided on the members.

The frames 4 of the members 1 may be individually attached to a base or be connected to one another in such a manner that they can execute a slight rotation with respect to one another, so that the device can easily adapt to the base on which it rests. The frames 4 may be made from a suitable plastic, so that the device is lightweight and therefore easy to handle. The leaf spring 5 may be made from a metal or a plastic.

A considerable advantage of the device according to the invention is, furthermore, that, in the non-activated state, it forms a hard base, which is important, for example, during operations in connection with the possibility of performing a heart massage.

Figure 5:
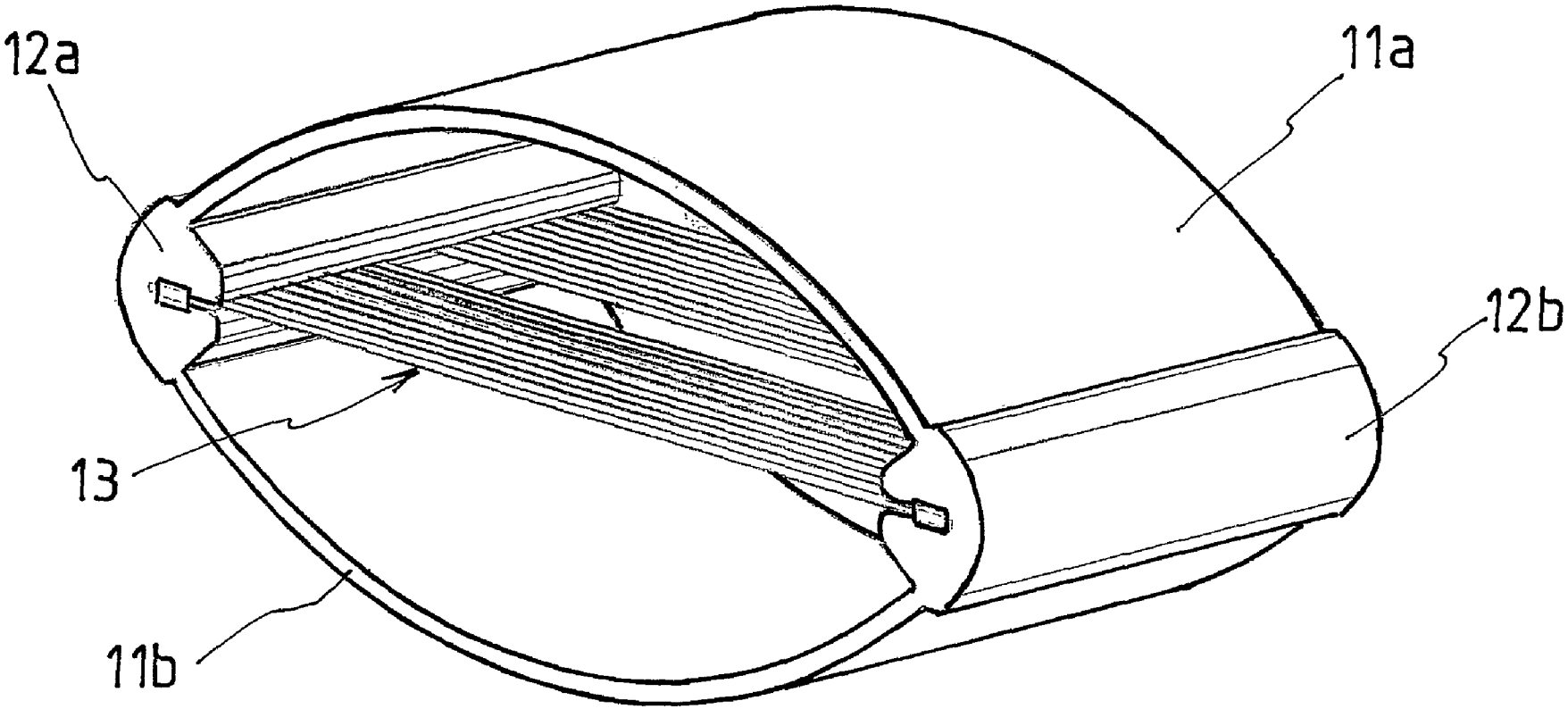
FIG. 5 shows a perspective view of a different embodiment of a member of the device according to the invention.

FIG. 5 shows another embodiment of a member according to the invention, in which each member consists of two rectangular elastic panels 11*a* and 11*b* arranged one above the other, whose ends are connected to one another via a rigid beam 12*a* and 12*b*. The panels and the beams may optionally be integrally formed from a suitable plastic material. A pulling element 13 is arranged between the two beams 12*a* and 12*b*, which consists of a number of wires made of memory metal. The construction is such that, in the unstressed position of the pulling element 13, the panels 11*a* and 11*b* are in a slightly curved position. By heating the wires of the pulling element, these will contract and pull the two rigid beams towards one another, as a result of which the elastic panels will assume a relatively convex position and expand in the vertical direction. The members are individually attached to a base, for example by means of bonding, and connected to electrical heating means (not shown), which are driven in turn by the control device 3 for activating the various pulling elements as desired. The members are covered by a layer of flexible foam material.

Figure 6:
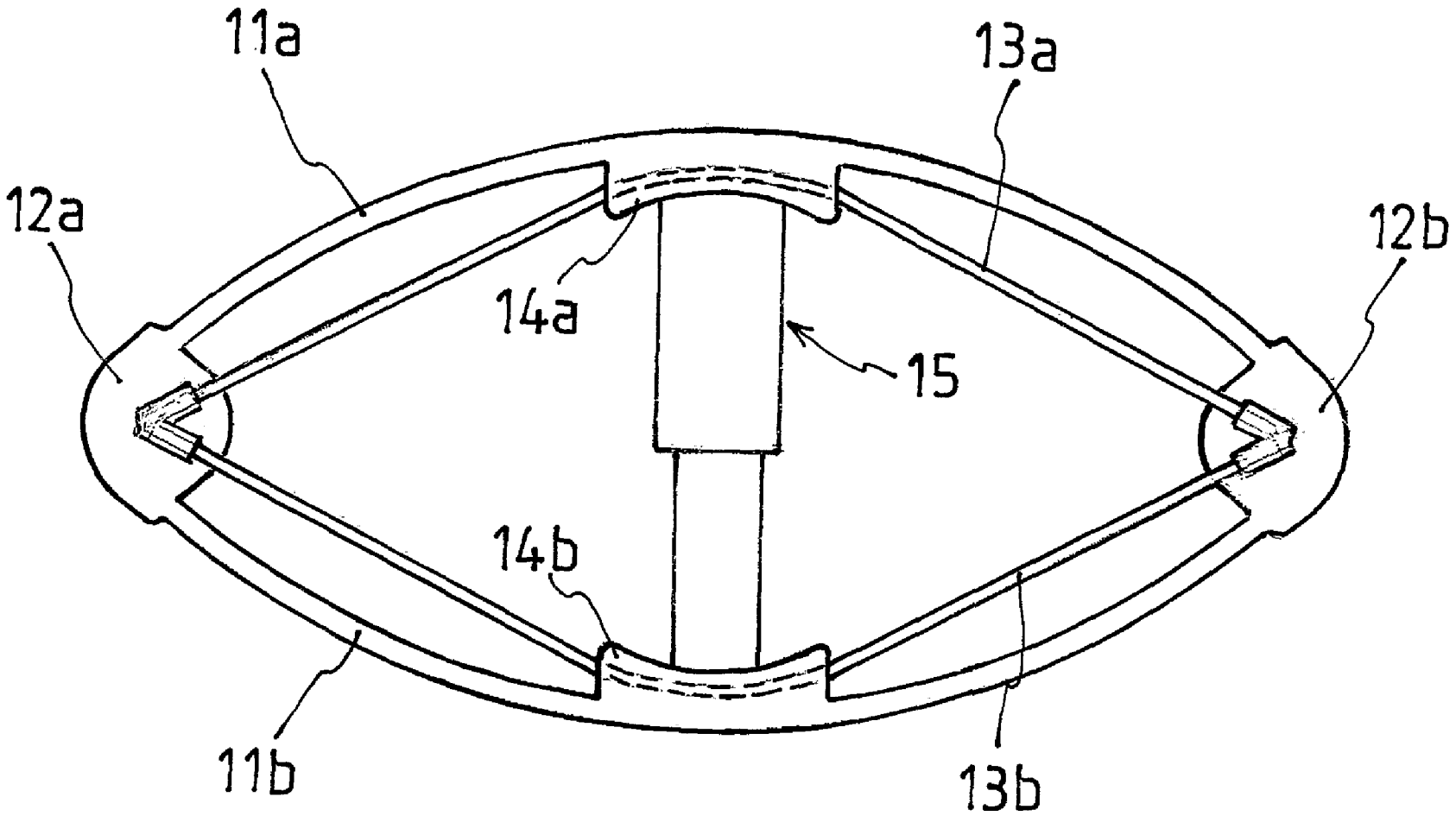
FIG. 6 shows a side view of a variant of the embodiment from FIG. 5.

FIG. 6 shows a variant of the member from FIG. 5. In this case, the pulling element again consists of wires from memory material, which wires are divided into two groups, i.e. 13*a* and 13*b*. Group 13*a* is guided over a guide 14*a*, which is arranged on the concave inside of the panel 11*a*, while the group of wires 13*b* is guided over a guide 14*b* on the concave inside of the bottom panel 11*b*. Of course, it is possible to arrange more than one guide on the inside of the panels, so that the wires follow the curvature of the panels more accurately.

The members which are constructed in this way can easily be attached to a suitable base and/or to a covering layer of flexible foam material. In this manner, a lightweight and easily displaceable device is thus obtained, it being possible to activate the members by means of a programmed control device according to any desired pattern or cycle of patterns. As a result of their relatively small dimensions, the individually activatable members in this case make a finely tuned adjustment of the supporting points for the patient possible.

If desired, a locking element 15 may be arranged between the two elastic panels 11*a* and 11*b* with the embodiment according to FIG. 6. Such a locking element may for example be arranged between the guides 14*a* and 14*b* and serve to lock the panels in their most convex position, so that the pulling element 13 is relieved in case of a static load. The locking element may be of any suitable type and design. What is important is that it becomes active when the pulling element is contracted and releases the panels when the pulling element expands again.

It will be clear that the invention is not limited to the embodiments illustrated and described here, but rather that a large number of variants are obvious to those skilled in the art without departing from the scope of the attached claims.

The invention claimed is:

1. Device for preventing decubitus, characterized by: a number of adjacent members which are attached to a base and which members are covered with a layer of elastic material which defines a reclining surface; each member comprises at least one elastic panel whose two opposite ends are connected to one another via a pulling element in order to be able to move the two ends of the elastic panel towards one another, so that the said panel can assume a curved position, in which the member has a relatively great vertical height; a control device for activating the pulling element for one or more of the members as desired, the pulling element being one or more strips or wires made of memory metal, which wires are connected to a heating element controlled by the control device in order to heat the wire, the pulling element designed such that it contracts upon heating, resulting in the elastic panel assuming a convex position.

2. Device according to claim 1, characterized in that each member comprises a frame, and the elastic panel with two opposite ends thereof is displaceably mounted in the frame.

3. Device according to claim 1, characterized in that the member consists of two identical panels, which are arranged in parallel and one above the other and the adjoining ends of which are connected to one another via a rigid beam and the pulling element is arranged between the two beams, in such a manner that the panels assume a slightly curved position in the stretched state of the pulling element with mutually opposite curvature.

4. Device according to claim 3, characterized in that the pulling element is guided by at least one guide arranged on the hollow side of the elastic panel.

5. Device according to claim 3, characterized in that the pulling element consists of two groups of wires, each group being guided by at least one guide arranged on the hollow side of one of the panels.

6. Device according to claim 1, characterized in that each member is attached to the base and/or to the covering layer of elastic material.

7. Device according to claim 1, characterized in that a locking element is present in order to lock the position of the elastic panel of the member when the pulling element is contracted.

* * * * *